US008562904B2

(12) United States Patent
Banhart et al.

(10) Patent No.: US 8,562,904 B2
(45) Date of Patent: Oct. 22, 2013

(54) METHOD FOR THE POWDER-METALLURGICAL PRODUCTION OF METAL FOAMED MATERIAL AND OF PARTS MADE OF METAL FOAMED MATERIAL

(75) Inventors: John Banhart, Klein-Machnow (DE); Francisco Garcia-Moreno, Berlin (DE)

(73) Assignee: Helmholtz-Zentrum Berlin fuer Materialien und Energie GmbH, Berlin (DE)

( * ) Notice: Subject to any disclaimer, the term of this patent is extended or adjusted under 35 U.S.C. 154(b) by 1290 days.

(21) Appl. No.: 11/997,818

(22) PCT Filed: Aug. 2, 2006

(86) PCT No.: PCT/DE2006/001375

§ 371 (c)(1),
(2), (4) Date: Feb. 4, 2008

(87) PCT Pub. No.: WO2007/014559

PCT Pub. Date: Feb. 8, 2007

(65) Prior Publication Data

US 2008/0314546 A1 Dec. 25, 2008

(30) Foreign Application Priority Data

Aug. 2, 2005 (DE) ..... 10 2005 037 305

(51) Int. Cl.
*B22F 3/11* (2006.01)

(52) U.S. Cl.
USPC ..... 419/2; 164/61

(58) Field of Classification Search
USPC ..... 419/2; 164/61
See application file for complete search history.

(56) References Cited

U.S. PATENT DOCUMENTS

| | | | | |
|---|---|---|---|---|
| 5,151,246 | A * | 9/1992 | Baumeister et al. | 419/2 |
| 5,865,237 | A | 2/1999 | Schorghuber et al. | |
| 6,896,029 | B2 | 5/2005 | Dobesberger et al. | |
| 7,396,380 | B2 * | 7/2008 | Kretz et al. | 75/415 |
| 2003/0049150 | A1 * | 3/2003 | Singer et al. | 419/20 |

FOREIGN PATENT DOCUMENTS

| | | |
|---|---|---|
| DE | 4018360 | 5/1991 |
| DE | 10115230 | 11/2001 |
| EP | 0666784 | 8/1995 |
| EP | 0804982 | 11/1997 |
| EP | 1288320 | 3/2003 |
| EP | 1419835 | 5/2004 |
| GB | 1287994 | 9/1972 |
| JP | 01127631 | 5/1989 |
| WO | 0222295 | 3/2002 |
| WO | 2004063406 | 7/2004 |
| WO | 2005011901 | 2/2005 |

OTHER PUBLICATIONS

R. Kretz, "Permanent aluminium foam cores in castings: Casting processes and fabrication conditions of foam filled parts", Materials Science Forum, Aendermannsfdorf, CH, vol. 369-402, No. Part 2, 2002, pp. 1609-1614, XP009037880.

J. Bahnhart, "Manufacturing routes for metallic foams", JOM, Minerals Metals & Materials Society, Warrendale, PA, US, vol. 52, No. 12, Dec. 2000, pp. 22-27, XP009012096.

* cited by examiner

*Primary Examiner* — Weiping Zhu
(74) *Attorney, Agent, or Firm* — Leydig, Voit & Mayer, Ltd.

(57) ABSTRACT

A method for a powder-metallurgical production of metal foamed material and of parts made of metal foamed material includes mixing a pulverulent metallic material including at least one of a metal and a metal alloy; pressing, under mechanical pressure, the mixed pulverulent metallic material so as to form a dimensionally stable semi-finished product; placing the semi-finished product into a chamber that is configured to be sealed pressure-tight; sealing the chamber; heating the semi-finished product to a melting or solidus temperature of the pulverulent metallic material; once the melting or solidus temperature has been reached, reducing the pressure in the chamber from an initial pressure to a final pressure so that the semi-finished product foams so as to form a metal foam; and lowering the temperature of the metal foam so as to solidify the metal foam.

18 Claims, No Drawings

METHOD FOR THE POWDER-METALLURGICAL PRODUCTION OF METAL FOAMED MATERIAL AND OF PARTS MADE OF METAL FOAMED MATERIAL

CROSS REFERENCE TO RELATED APPLICATIONS

This is a U.S. national phase application under 35 U.S.C. §371 of International Patent Application No. PCT/DE2006/001375, filed Aug. 2, 2006, and claims benefit of German Patent Application No. 10 2005 037 305.4, filed Aug. 2, 2005. The International Application was published in German on Feb. 8, 2007 as WO 2007/014559 A1 under PCT Article 21(2).

FIELD

The invention relates to a method for the powder-metallurgical production of metal foamed material and of parts made of metal foamed material. Metal foamed material is also commonly called metal foam.

BACKGROUND

Aqueous solutions, plastics or glass can be foamed. Recent decades have seen repeated efforts aimed at foaming metals as well and at producing novel foams that have a novel property spectrum due to the combination of the typical foam morphology with the known advantages of metallic materials. Metal provides elasticity, strength and temperature resistance while foam provides low weight, damping, high porosity and a large specific surface area.

Metal foam is a novel material with a systematically created pore structure, it is non-combustible and exhibits great strength. Foams made of metal are airy materials that are lightweight, stiff and yet flexible and that absorb a great deal of energy in case of a crash. Metal foam can also fulfill a wide array of other technical tasks and is particularly suitable for applications such as thermal insulation, noise and vibration attenuation or as a compression element.

Metal foams can consist of up to 85 percent air and a mere 15 percent metal, which makes them very lightweight. They look like conventional synthetic foams but are much stronger. Up until a few years ago, the production methods were too laborious, too costly and too difficult to control, and consequently the results were rarely reproducible. In the meantime, however, melt and powder-metallurgical methods exist that promise to deliver a high quality of the foamed metal. Several methods are known and commonly used for the production of metal foams. For example, a slip is prepared at room temperature in order to make steel foam out of steel powder, water and a stabilizer. Phosphoric acid is added as a binder and foaming agent to this mixture. Two reactions then take place in the slip, leading to the formation of a stable foam structure. On the one hand, the reaction between the steel powder and the acid generates hydrogen gas bubbles that bring about the foaming. On the other hand, a metal phosphate is formed whose adhesive effect solidifies the pore structure. The foam thus created is dried and subsequently sintered without generating any pollutants to form a metallic composite.

A melt-metallurgical method is described, for example, in European patent application EP 1 288 320 A2, in which gas bubbles are introduced into a melt. In order to do so, at least one gas feed pipe with a defined gas outlet cross section protrudes into the melt and individual bubbles are blown into the melt through this pipe. The size of the bubbles is controlled by the setting of the inflow parameters of the gas.

European patent application EP 1 419 835 A1 describes a method and a device for the production of flowable metal foam with a monomodal distribution of the dimensions of the void spaces, likewise based on a melt-metallurgical method. In this context, at least two adjacent feed pipes that are similarly dimensioned and positioned at a defined distance from each other protrude into a metallurgical vessel containing a foamable metal melt. Bubbles are formed in the areas of the protruding pipe ends, whereby a contiguous foam formation is created when areas of the bubble surfaces come to lie against each other and partition walls containing particles are formed.

A drawback of these melt-metallurgical methods is that a metal melt cannot be foamed in its pure state. In order to make the metal melt foamable, it has to be mixed with an agent that increases the viscosity, for example, an inert gas (GB 1,287,994) or with ceramic particles (EP 0 666 784 B) before the foaming is carried out. Only the metal foam that accumulates on the melt surface can flow. Even though this is favorable when it comes to shaping the metal foam, the insufficient stabilization of the metallic walls can lead to a partial collapse of the formed metal foam and thus to the uncontrollable formation of dense zones inside an object produced in this way. Moreover, some of the formed bubbles or the dissolved gas can escape from the melt while the latter is solidifying, so that the released gas is no longer trapped in the melt, resulting in a low porosity of the objects made by means of this method. Moreover, the incorporation of the gas bubbles into the melt requires complex equipment.

A powder-metallurgical method for the production of porous metal objects is described in German patent DE 101 15 230 C2, in which a mixture of a gas-cleaving powder containing a foaming agent and a pulverulent metallic material containing at least one metal and/or a metal alloy is compacted to form a semi-finished product. This semi-finished product is foamed under the effect of heat, a process in which a powder containing a foaming agent is used whose temperature of maximum decomposition is less than 120 K below the melting temperature of the metal or the solidus temperature of the metal alloy. For purposes of producing metal parts having an internal porosity, international patent application WO 2005/011901 A1 describes to first create a foamable semi-finished product consisting of metal and at least one foaming agent that releases gas at an elevated temperature, whereby the metal forms an essentially closed matrix into which foaming agent particles are embedded. The quality of the metal object produced is supposed to be enhanced with a semi-finished product in which the metal matrix that traps the foaming agent particles is formed by the diffusion-welding and/or pressure-welding of metal particles. Towards this end, in a first step, metal particles and at least one agent that releases gas(es) at an elevated temperature, so-called foaming agents, are mixed together, after which, in a second step, the mixture is shaped under elevated pressure and elevated temperature to form a semi-finished part that is allowed to cool off or is cooled down to a temperature below the decomposition or outgassing temperature of the foaming agent while the application of pressure is maintained. In a third step, the semi-finished product is heated to above the decomposition temperature of the foaming agent and, with the creation of internal porosity, the semi-finished product is shaped into a metal foam part.

Another method for the production of metal foam objects is described in international patent application WO 2004/063406 A2. This method can be employed as a powder-metallurgical method or as a melt-metallurgical method. With this solution, a feed material is melted under atmospheric pressure in an open melting vessel without excess-pressure devices and gas is introduced into the liquid phase of the feed material at the same time and/or subsequently, so that the introduction of foaming agent or gas sufficiently provides the melt with gas in order to form a metal foam object having a low density when the melt solidifies. According to the described solution, this effect can be beneficially utilized to produce a metal foam object that has the desired shape if the liquid metal is first placed into a mold and then allowed to solidify in it under ambient pressure that is reduced, at least at times. Due to the solidification of the melt at a reduced ambient pressure, preferably 0.03 bar to 0.2 bar, numerous gas bubbles are formed in the melt but these become trapped in it due to the onset or continuation of the solidification of the melt so that metal foam objects produced in this manner have a low density.

Japanese publication JP 01-127631 (Abstract) likewise describes a method in which, analogously to the above-mentioned solution, hydrogen, nitrogen and oxygen are introduced under atmospheric pressure into the liquid metal or else foaming agent particles such as nitride, hydride or oxide release gas into the melt by means of thermal cracking. The liquid metal mixed with gas is placed into a shaping mold and kept for a certain period of time at a reduced pressure of 400 to 760 mmHg.

High-quality metal foam objects can be created by such powder-metallurgical methods. However, these methods are extremely complex in terms of the material employed and the equipment needed since they call for at least two powder components, namely, metal particles and foaming agent particles. Also, the individual powder components have to be thoroughly mixed prior to any heating and the powder grains have to be sintered together, for instance, by hot isostatic pressing, in order to obtain pores with the best possible homogeneous distribution in the finished metal foam objects. Another drawback lies in the fact that gas already escapes from the foaming agent particles prior to the melting of the metal and then it accumulates in cracks, flaws, etc. This gives rise to pores that are of different sizes and irregularly distributed in the metal foam. The pore size and the volume expansion are difficult to control during the process.

SUMMARY

It is an aspect of the present invention to provide a method for the production of metal foam and of parts made of metal foam, said method being easy to carry out without the use of foaming agents and without complex equipment, whereby the trapped pores are as small as possible and have a virtually uniform volume and a homogeneous distribution. The parts made of metal foam using the method according to the invention exhibit a high degree of dimensional stability.

In an embodiment the present invention provides a method for a powder-metallurgical production of metal foamed material and of parts made of metal foamed material that includes mixing a pulverulent metallic material including at least one of a metal and a metal alloy; pressing, under mechanical pressure, the mixed pulverulent metallic material so as to form a dimensionally stable semi-finished product; placing the semi-finished product into a chamber that is configured to be sealed pressure-tight; sealing the chamber; heating the semi-finished product to a melting or solidus temperature of the pulverulent metallic material; once the melting or solidus temperature has been reached, reducing the pressure in the chamber from an initial pressure to a final pressure so that the semi-finished product foams so as to form a metal foam; and lowering the temperature of the metal foam so as to solidify the metal foam.

DETAILED DESCRIPTION

According to an aspect of the present invention a pulverulent metallic material containing at least one metal and/or a metal alloy is mixed and subsequently pressed to form a dimensionally stable semi-finished product under mechanical pressure at a temperature of up to 400° C. [752° F.]. This semi-finished product is placed into a chamber that can be sealed pressure-tight that is subsequently sealed pressure-tight and the semi-finished product is heated up at the selected initial pressure to the melting or solidus temperature of the pulverulent metallic material. Once the melting or solidus temperature of the pulverulent metallic material has been reached, the pressure in the chamber is reduced to a selected final pressure. In this process, the semi-finished product foams and the metal foam thus formed solidifies during the subsequent drop in the temperature. The temperature is lowered after the beginning of the pressure reduction according to a prescribed gradient, whereby the selected final pressure is always reached before the pulverulent metallic material solidifies.

It has been found to be advantageous for a gas pressure of up to 50 bar to be generated in the sealed chamber before or while the semi-finished product is being heated up. Once the melting or solidus temperature of the pulverulent metallic material has been reached, the pressure in the sealed chamber is reduced according to a prescribed gradient from the initial pressure to the final pressure of 1 bar. Another alternative includes heating up the semi-finished product in the sealed chamber at an initial pressure of about 1 bar and, once the melting or solidus temperature of the pulverulent metallic material has been reached, the pressure in the sealed chamber is reduced according to a prescribed gradient to a final pressure of about 0.1 bar to 0.01 bar. However, after the foaming, the pressure can also be reduced to other final pressures, for instance, from an initial pressure of up to 50 bar to a final pressure of >1 bar or to <1 bar.

In the sealed chamber, a certain gas atmosphere can be created, for example, an oxygen atmosphere or an atmosphere having moist air.

In order to produce the dimensionally stable semi-finished product, the pulverulent metallic material is preferably compacted at a gas pressure between 1 bar and 50 bar as well as at a mechanical pressure ranging from 200 MPa to 400 MPa at a temperature of up to 400° C. [752° F.].

The pulverulent metallic material may be pretreated prior to being compacted in that the surface of the individual grains of the pulverulent metallic material is modified, for instance, through oxidation or moistening.

According to an aspect of the present invention, dimensionally stable metal foam objects can also be easily produced if, instead of some other type of pressure-tight chamber, a shaping mold that can be sealed pressure-tight is employed that has the shape of the metal foam object that is to be produced.

A reservoir situated in the shaping mold provides that the excess metal foam created by the foaming of the metal can escape from the shaping mold through an opening leading into the reservoir. As a result, the shaping mold is filled completely with the metal foam. When the pressure is reduced, the temperature is also lowered, so that the metal foam solidifies in the mold and acquires the shape of the shaping mold. Once the metal foam has solidified, the metal foam object can be removed from the shaping mold.

Advantages of the method according to the present invention lie especially in the fact that it is possible to easily produce metal foam or objects made of metal foam, without complex equipment for introducing gas bubbles into the melt and without using foaming agents. Another advantage is that the method according to the present invention can be used to produce metal foam having a low density, in which the pores have small dimensions (volumes), are virtually of a uniform size and are homogeneously distributed throughout the metal foam. Another advantage is that, thanks to the fact that various pressure differentials between the initial and the final pressure can be set, the pore size and the volume expansion can be selected or set very easily and precisely within certain limits during the process, whereby there is a direct relationship between the pore size and the volume expansion. In other words, taking certain limit values into account, the pore size and the volume expansion can be predetermined by establishing the initial pressure and the final pressure. However, it is also possible to monitor the process and to terminate it at any time once the desired pore size or volume expansion has been reached.

If the semi-finished product made of pulverulent metallic material is not foamed in a simple chamber but instead in a shaping mold, dimensionally stable metal foam objects can be produced in a simple manner.

The invention will be described in greater detail below with reference to two selected exemplary embodiments.

In the first preferred method, a metal foam is produced without the use of additional foaming agents that release a gas. For this purpose, in a first process step, aluminum powder (99.7) having an average grain size of about 20 μm is uniaxially compacted in a metal cylinder at a gas pressure of 1 bar as well as at a mechanical pressure of 300 MPa and at a temperature of approximately 400° C. [752° F.] over a period of 15 minutes to form a semi-finished product.

Subsequently, this semi-finished product is placed into a pressure-tight chamber and heated up, in an air atmosphere at an initial pressure of $p_1$=10 bar, to a temperature of about 700° C. [1292° F.], which thus lies somewhat above the melting temperature of aluminum, which is about 660° C. [1220° F.]. If this temperature is maintained for a sufficiently long period, the semi-finished product melts. As soon as the semi-finished product has melted completely, the gas pressure in the chamber is reduced from the initial pressure $p_1$=10 bar to the final pressure $p_2$=1 bar at a gradient of 0.2 bar/s so that the gas trapped in the semi-finished product expands at the same ratio at which the gas pressure is reduced in the chamber, thus causing the specimen to foam within approximately 45 seconds. The average pore size is about 2 mm. Finally, the temperature in the chamber is reduced by approximately 5K/s until it falls below the melting temperature of aluminum, so that the liquid aluminum foam solidifies, as a result of which the aluminum foamed material hardens.

In another exemplary embodiment, a method is presented with which an aluminum foam is produced using small amounts of foaming agents that release gas.

In a first process step, powder consisting of AlSi6Cu4 and having an average grain size of about 20 μm containing 0.5% by weight of $TiH_2$, which has an average grain size of about 10 μm, is homogeneously mixed. This mixture is uniaxially compacted in a metal cylinder at a gas pressure of 1 bar as well as at a mechanical pressure of 300 MPa at a temperature of about 400° C. [752° F.] over a period of approximately 15 minutes to form a semi-finished product. Subsequently, this semi-finished product is placed into a pressure-tight chamber and heated up in an air atmosphere at an initial pressure of 8 bar to a temperature of about 550° C. [1022° F.], which thus lies somewhat above the solidus temperature of AlSi6Cu4, which is approximately 516° C. [960.8° F.]. Already at temperatures above 400° C. [752° F.], the foaming agent starts to release hydrogen. Owing to the external pressure, the gas that is released and trapped in the molten aluminum of the semi-finished product forms very small pores having an average diameter of less than 0.1 mm. As soon as the semi-finished product has melted completely, the gas pressure in the chamber is reduced from the initial pressure $p_1$=8 bar by approximately 3 bar to a final pressure $p_2$=5 bar at a gradient of 0.2 bar/s. In this process, the gas trapped in the semi-finished product causes the specimen to foam within 15 seconds. Once the AlSi6Cu4 foam has reached the prescribed volume, the temperature is reduced by approximately 5 K/s until it falls below the solidus temperature of AlSi6Cu4, so that the liquid AlSi6Cu4 foam solidifies and consequently the foamed material hardens.

An AlSi6Cu4 foam produced with this method has pores that are homogeneously distributed in the metal foam, that are small and round, and that have an average size of about 0.5 mm. The size of the pores can simply be set on the basis of the selected pressure differential between the initial pressure and the final pressure ($\Delta p=p_1-p_2$) over two orders of magnitude from diameters of approximately 0.1 mm to approximately 10 mm.

The invention claimed is:

1. A method for a powder-metallurgical production of a metal foamed material and of parts made of metal foamed material, the method comprising:

mixing a pulverulent metallic material including at least one of a metal and a metal alloy;

pressing, under mechanical pressure, the mixed pulverulent metallic material so as to form a dimensionally stable semi-finished product;

placing the semi-finished product into a chamber that is configured to be sealed pressure-tight;

sealing the chamber;

heating the semi-finished product to a melting or solidus temperature of the pulverulent metallic material;

once the melting or solidus temperature has been reached, reducing the pressure in the chamber from an initial pressure to a final pressure of at least 1 bar so that the semi-finished product foams without the use of a foaming agent so as to form a metal foam; and lowering the temperature of the metal foam so as to solidify the metal foam.

2. The method according to claim 1, further comprising pretreating the pulverulent metallic material by modifying a surface of an individual powder grains of the pulverulent metallic material.

3. The method according to claim 2, wherein the pulverulent metallic material is pretreated through oxidation or moistening.

4. The method according to claim 1, wherein the pulverulent metallic material includes powder grains having dimensions that average about 1 μm to 100 μm.

5. The method according to claim 1, wherein the pressing includes compacting the mixed pulverulent metallic material at a gas pressure between 1 bar and 50 bar as well as at a mechanical pressure ranging from 200 MPa to 400 MPa at a temperature of less than 400° C.

6. The method according to claim 1, further comprising pretreating the semi-finished product so as to modify the surface by at least one of oxidation, electrolytic oxidation or moistening.

7. The method according to claim 1, wherein the sealed chamber has a defined gas atmosphere.

8. The method according to claim 7, wherein the defined gas atmosphere is an oxygen atmosphere.

9. The method according to claim 7, wherein the defined gas atmosphere is moist air.

10. The method according to claim 1, wherein the initial pressure is less than approximately 50 bar before or while the semi-finished product is heated.

11. The method according to claim 10, wherein, once the melting or solidus temperature of the pulverulent metallic material has been reached, the pressure in the sealed chamber is reduced according to a prescribed gradient from the initial pressure to the final pressure, the final pressure being about 1 bar.

12. The method according to claim 1, wherein the reducing is performed from the initial pressure to the final pressure within a time span of about 1 second to 1000 seconds.

13. The method according to claim 1, wherein the temperature in the chamber is only lowered after the beginning of the pressure reduction according to a prescribed gradient, whereby the solidification temperature of the pulverulent metallic material is only reached after the final pressure has been reached.

14. The method according to claim 1, further comprising systematically setting the size of the pores in the metal foam within a range from approximately 0.1 mm to approximately 10 mm by selecting a pressure differential between the initial pressure and the final pressure.

15. The method according to claim 13, wherein the reducing the pressure is terminated and the lowering the temperature is subsequently performed so as to lower the temperature of the metal foam below the solidification temperature of the pulverulent metallic material so as to terminate an increase of a pore size in the metal foam.

16. The method according to claim 1, wherein the reducing the pressure is performed so as to set a volume expansion of the metal foam to about ten times an initial volume.

17. The method according to claim 16, wherein the reducing the pressure is terminated and the lowering of the temperature is subsequently performed so as to lower the temperature of the metal foam below the solidification temperature so as to terminate a volumetric expansion of the metal foam.

18. The method according to claim 1, wherein the lowering the temperature is performed so as to solidly the metal foam so as to provide a dimensionally stable metal foam object.

* * * * *